United States Patent [19]

Di Pietro

[11] 4,358,982

[45] Nov. 16, 1982

[54] IN TONE GENERATORS FOR ELECTRONIC MUSICAL INSTRUMENTS

[75] Inventor: Massimo Di Pietro, Rieti, Italy

[73] Assignee: Texas Instruments Incorporated, Dallas, Tex.

[21] Appl. No.: 117,321

[22] Filed: Jan. 31, 1980

[30] Foreign Application Priority Data

Jan. 31, 1979 [IT] Italy ..... 47843 A/79
Jul. 13, 1979 [IT] Italy ..... 49755 A/79

[51] Int. Cl.[3] ..... G10H 1/04; G10H 5/06
[52] U.S. Cl. ..... 84/1.24; 84/DIG. 11
[58] Field of Search ..... 84/1.24–1.27, 84/DIG. 11, DIG. 18

[56] References Cited

U.S. PATENT DOCUMENTS 3,647,928 3/1972 Turner ..... 84/1.24
3,952,625 4/1976 Peterson ..... 84/DIG. 18
4,043,243 8/1977 Peterson ..... 84/1.25
4,056,996 11/1977 Bunger ..... 84/1.24 X
4,145,943 3/1979 Luce ..... 84/1.24 X

*Primary Examiner*—Stanley J. Witkowski
*Attorney, Agent, or Firm*—N. Rhys Merrett; Melvin Sharp; Gary Honeycutt

[57] ABSTRACT

A tone generator for electronic musical instruments, useful in particular for the modular composition of an electronic organ, comprising a plurality of inputs corresponding to a keyboard octave of the musical instrument. The inputs are connected to a plurality of groups of analog modulators which receive, respectively, tone signals produced by a tone generator and submultiples thereof produced by a plurality of toggles according to the number of footages desired on the output of the groups of modulators. The tone generator includes an audio frequency modulator having a high modulation index with full modulation depth remaining substantially constant over the whole supply voltage range.

16 Claims, 34 Drawing Figures

| FOOTAGE | | 1st TONE (Hz) | | LAST TONE (Hz) | |
|---|---|---|---|---|---|
| EVEN | 16' | 32.7 | (C1) | 1046.5 | (C6) |
| | 8' | 65.4 | (C2) | 2093.0 | (C7) |
| | 4' | 130.8 | (C3) | 4186.0 | (C8) |
| | 2' | 261.6 | (C4) | 8372.0 | (C9) |
| | 1' | 523.2 | (C5) | 16744.0 | (C10) |
| ODD | $5\frac{1}{3}$' | 97.9 | (G2) | 3135.9 | (G7) |
| | $2\frac{2}{3}$' | 195.9 | (G3) | 6270.9 | (G8) |
| | $1\frac{3}{5}$' | 329.6 | (E4) | 10548.0 | (E9) |
| | $1\frac{1}{3}$' | 391.9 | (G4) | 12541.8 | (G9) |

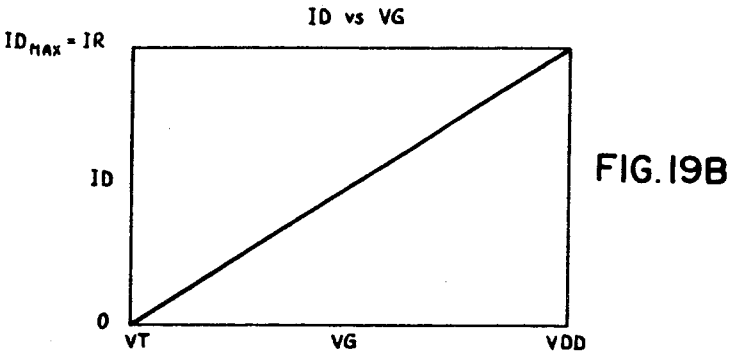
FIG. 19B
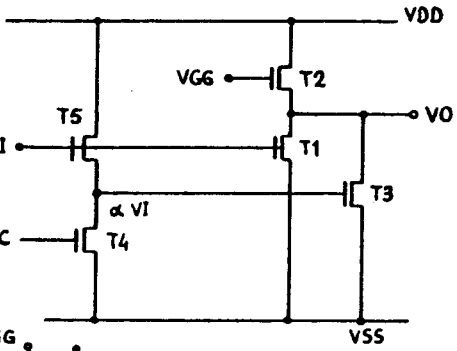
FIG. 24
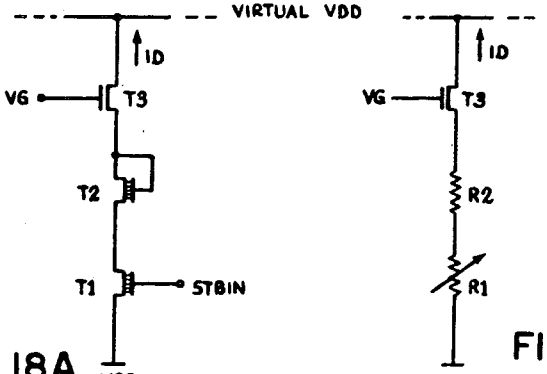
FIG. 18A
FIG. 18B
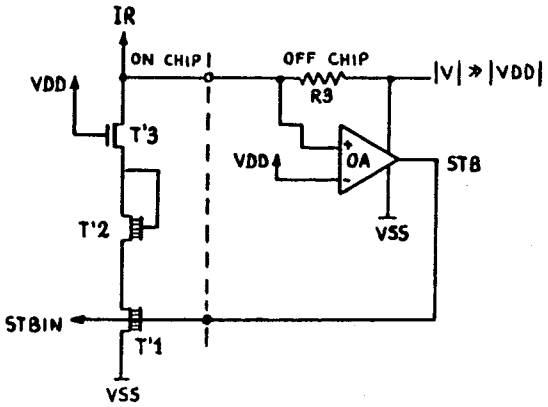
FIG. 19A
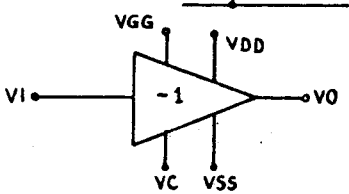

IN TONE GENERATORS FOR ELECTRONIC MUSICAL INSTRUMENTS

The present invention relates to an improvement in tone generators for electronic musical instruments.

More particularly, the present invention relates to a generator and selector of tones organized on an octave basis, particularly suited for fabrication as a monolithic integrated circuit, and which permits a simplified modular construction of an electronic musical instrument such as an organ, permitting obviation of several inconveniences which are encountered in the known art.

The invention also relates to an improvement in modulators with high modulation index in particular for audio frequencies, with full modulation depth substantially constant over the whole range of supply voltages.

A typical tone generator as presently known in the art will be described by way of exemplary background with reference to FIS. 1 to 7 of the drawings, wherein.

GENERAL CONCEPTS

Figures 1, 2:
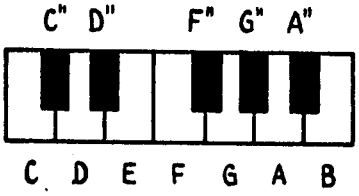
FIG. 1 (PRIOR ART)
FIG. 2 (PRIOR ART)
FIG. 1 shows a typical keyboard octave.
FIG. 2 shows a table of notes and their related frequencies.

A tone constitutes the basic element of music and is constituted by a fixed frequency sound generally associated with a number of harmonics. The structure and composition of the harmonics is outside of the scope of the present discussion. The tones are grouped in octaves, each octave including 12 separate tones which are identified (according to Anglo-Saxon terminology) as shown in FIG. 1. The octaves are sequentially numbered with integers starting from the lowermost one (1, 2, 3, . . . ). For example, the tones C1 and C9 have a frequency of 32.7 Hz and 8,372 Hz, respectively. A group of five consecutive octaves plus one tone is commonly known as footage. The footages which are commonly encountered in electronic organs are shown schematically in FIG. 2. It is to be noted that in practice frequencies above C9 and below C2 are not encountered.

REQUIREMENTS OF AN ELECTRONIC INSTRUMENT

An electronic organ, and more generally any electronic musical instrument requires an array of tone generators, each of which is selected every time a given key is pushed. In the case of an electronic organ, if the organ has only one footage, each key will always select the same tone. If more than one footage is present, each key will select a number of tones corresponding to the number of footages. These tones are made available by the draw bar controls, generally placed on the front of the instrument, and controlled through keys.

The following is required of the electronics of a musical instrument:

(a) generation of all the requested frequencies (tones);

(b) selection of the tones of the several footages by means of a single contact for each key;

(c) elimination of the transients deriving from the closing and opening of the key contacts commonly known as "key click";

(d) possibility of having a programmable decay time at the release of the key (sustain), and more generally the possibility of amplitude modulating the tones with various envelopes for producing special effects.

PRIOR ART

Figure 3:
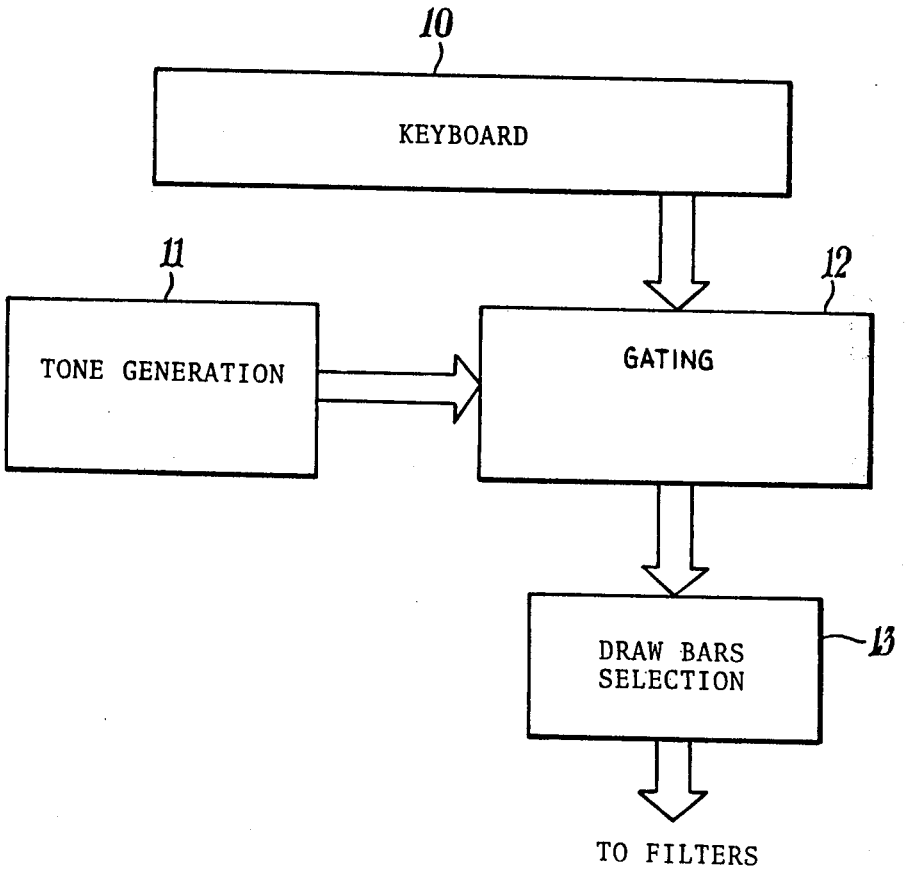
FIG. 3 (PRIOR ART)
FIG. 3 shows the general block schematic diagram of an electronic organ according to known art.

In electronic organs there are present several functional blocks and the present discussion will be limited to certain ones having particular pertinence to the present invention. FIG. 3 shows a keyboard 10, a tone generator 11, a gating unit 12 for the switching and distribution of the signals which provides for the selection of tones according to the keys which are pushed, and a set of controls for the draw bars 13. The output of the draw bars is connected to banks of filters for the spectral composition of the musical tones.

Figure 4:
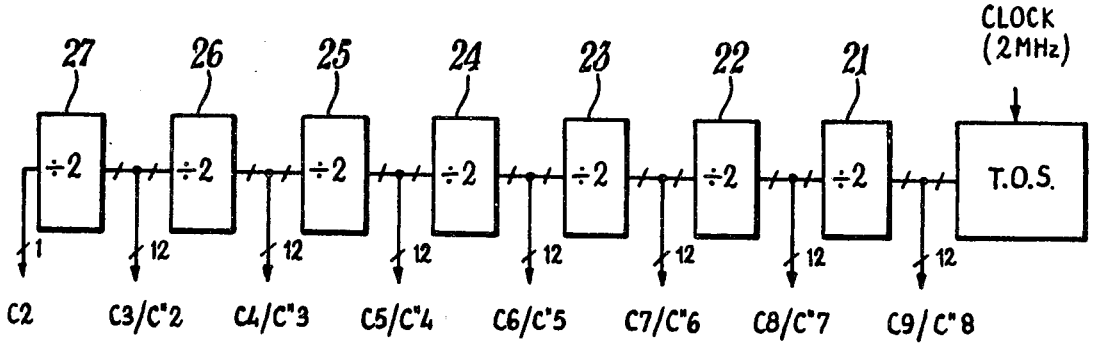
FIG. 4 (PRIOR ART)
FIG. 4 shows a tone generator according to known art.

FIG. 4 shows how tones typically are generated according to existing practices. This solution comprises generating by means of a dedicated integrated circuit the twelve tones having the highest frequencies and through division by multiples of two, obtaining tones relating to the lower octaves. The integrated circuit 20 in FIG. 4 is commonly identified as T.O.S. (Top Octave Synthesizer) and it is commercially available (AY-1-0212 of GIE; ESM 159.C of SESCOSEM, or MK5024 of Mostek). The circuit 20 has 12 outputs which are applied to twelve chains of toggles connected in cascade only one of which 21, 22, 23, 24, 25, 26, 27 is shown. The chain of toggles normally comprises integrated circuits each of which includes seven toggles. Consequently, for the generation of 85 tones a total of 12 integrated circuits is required together with a large number of output leads which complicate the construction of printed circuit boards on which the integrated circuit boards are mounted and give rise to difficulties created by crosstalk.

Figure 5:
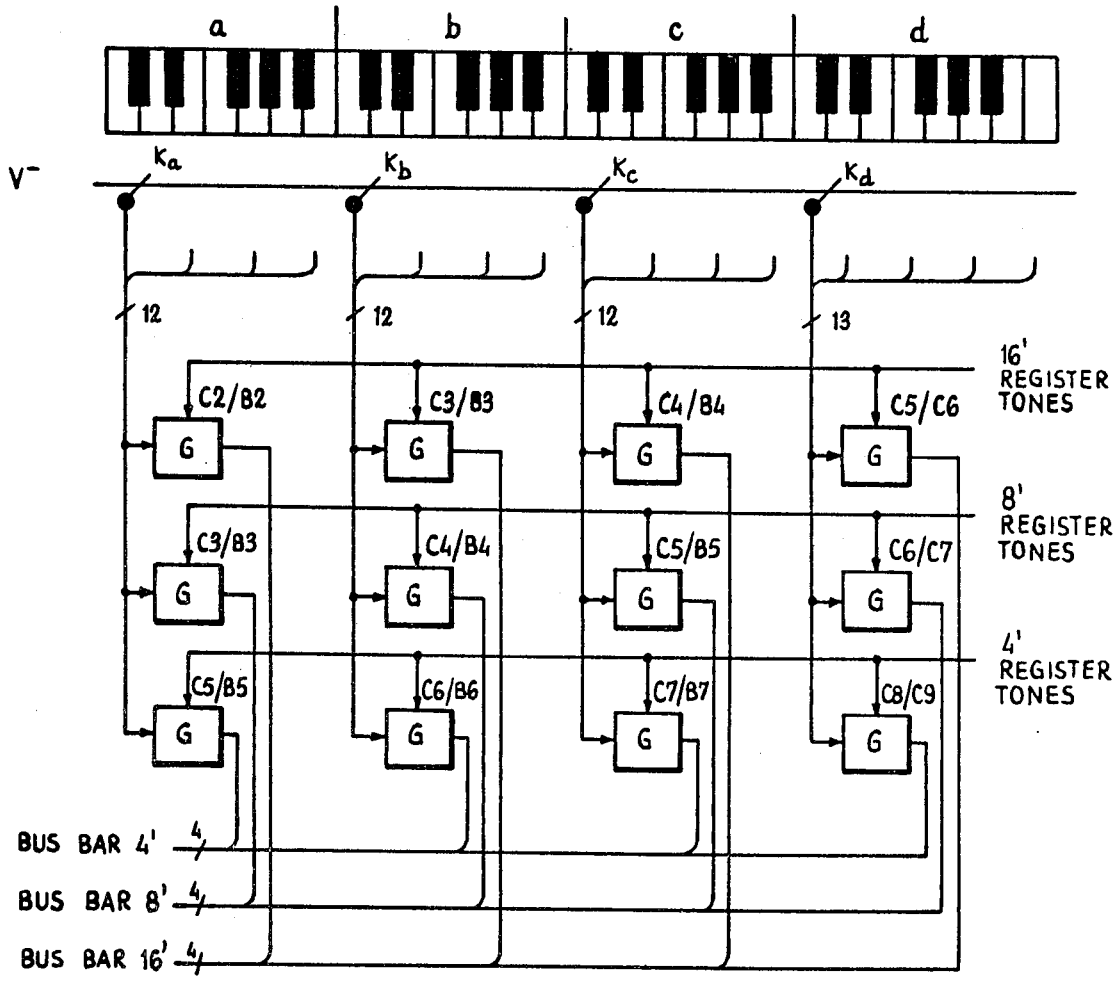
FIG. 5 (PRIOR ART)
FIG. 5 shows the schematic diagram of a system for the control and distribution of signals according to known art.
Figure 6:
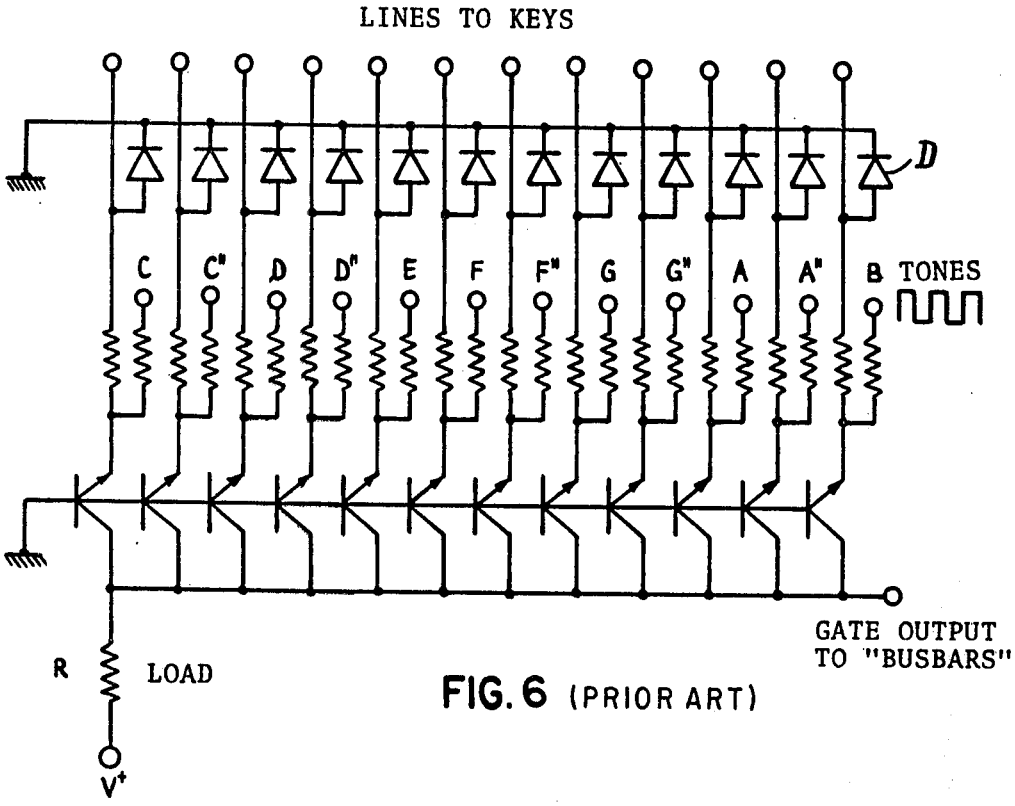
FIG. 6 (PRIOR ART)
FIG. 6 shows a signal control circuit according to known art.

Refer now to FIG. 5 where a current solution of the signal switching and distribution unit 12 in FIG. 3 is exemplified. In FIG. 5 there is shown schematically the structure of the switching and distribution unit for an electronic organ which includes four octaves and three footages. As exemplified in this figure, there are four key-board octaves a, b, c, d, with the single keys (twelve for each octave) which control corresponding contacts $k_a$, $k_b$, $k_c$, $k_d$, which provide a control voltage V− to first inputs of the gating circuits G, to which are fed tone signals produced by circuits similar to the one shown in FIG. 4. Each gating circuit G is shown in more detail in FIG. 6. When a key contact is closed, a negative voltage is applied on the corresponding key line, and a current flows in the corresponding transistor. This current is on/off—modulated by the voltages of the tone generators which go from ground to V+. If several keys are activated at the same moment, the resulting current through the load resistor R, is the sum of the individual currents. The diodes D prevent emitter breakdown when the key is released. Usually, arrays of transistors are used such as the TBA 470 (I.T.T.).

Figure 7:
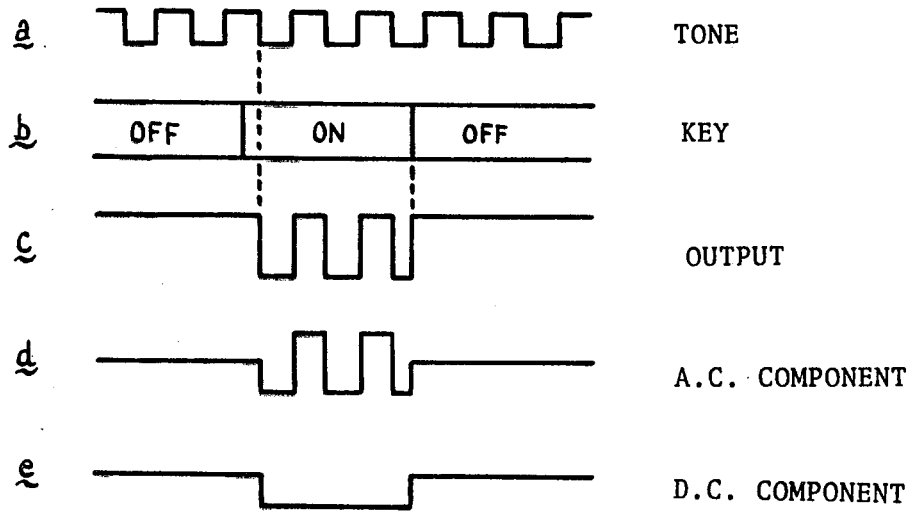
FIG. 7 (PRIOR ART)
FIG. 7 shows switching waveforms according to known art.

The waveforms appearing on the output of one of the circuits G of FIG. 5 is shown in FIG. 7, in which the waveform a comes from the tone generator; the waveform b shows the closure and opening of a key contact;

the waveform c is the output of the general circuit G and which comprises as it is shown by the waveforms d and e, an a.c. component and a d.c. component, respectively. The d.c. component e is particularly undesirable because it produces a disturbing noise known as "key click" which can be eliminated only with difficulty.

The present invention is concerned with providing a circuit arrangement, which preferably may be realized as a large-scale integrated circuit in a single package, which may be associated to each keyboard octave and which permits generation of all the frequencies related to that octave together with all those relating to the footages or registors of the organ. Therefore, considering a general octave, the circuit will produce 12 frequencies in the case of a single register, and 12 N frequencies in the case in which the circuit is arranged for N registers. Naturally, if the circuit comprises M registers (M>N), it is possible to associate several circuits of this kind to each keyboard octave up to reaching the desired number of registers.

Figure 8:
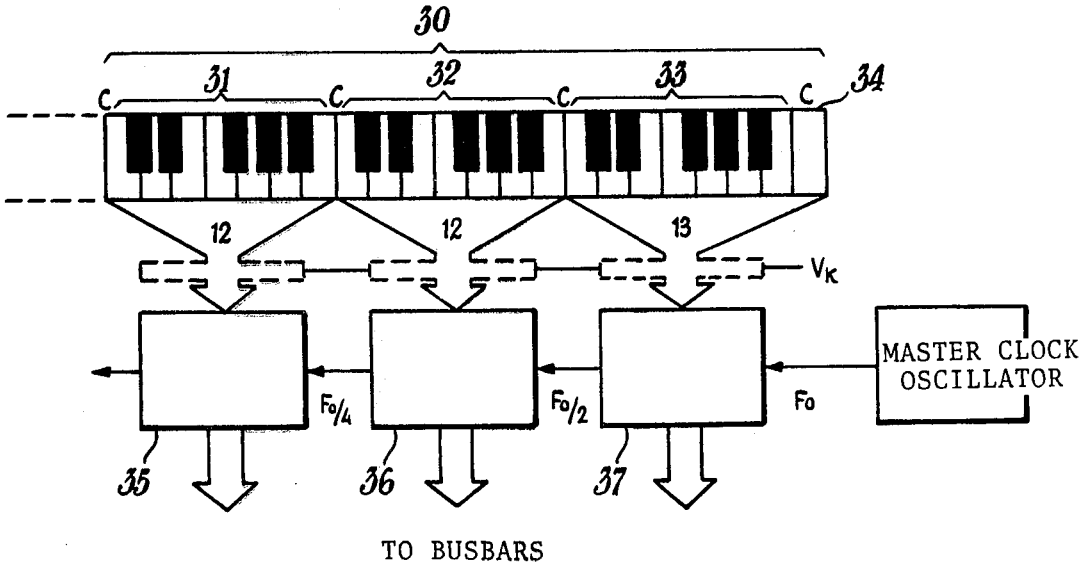
Figure 9:
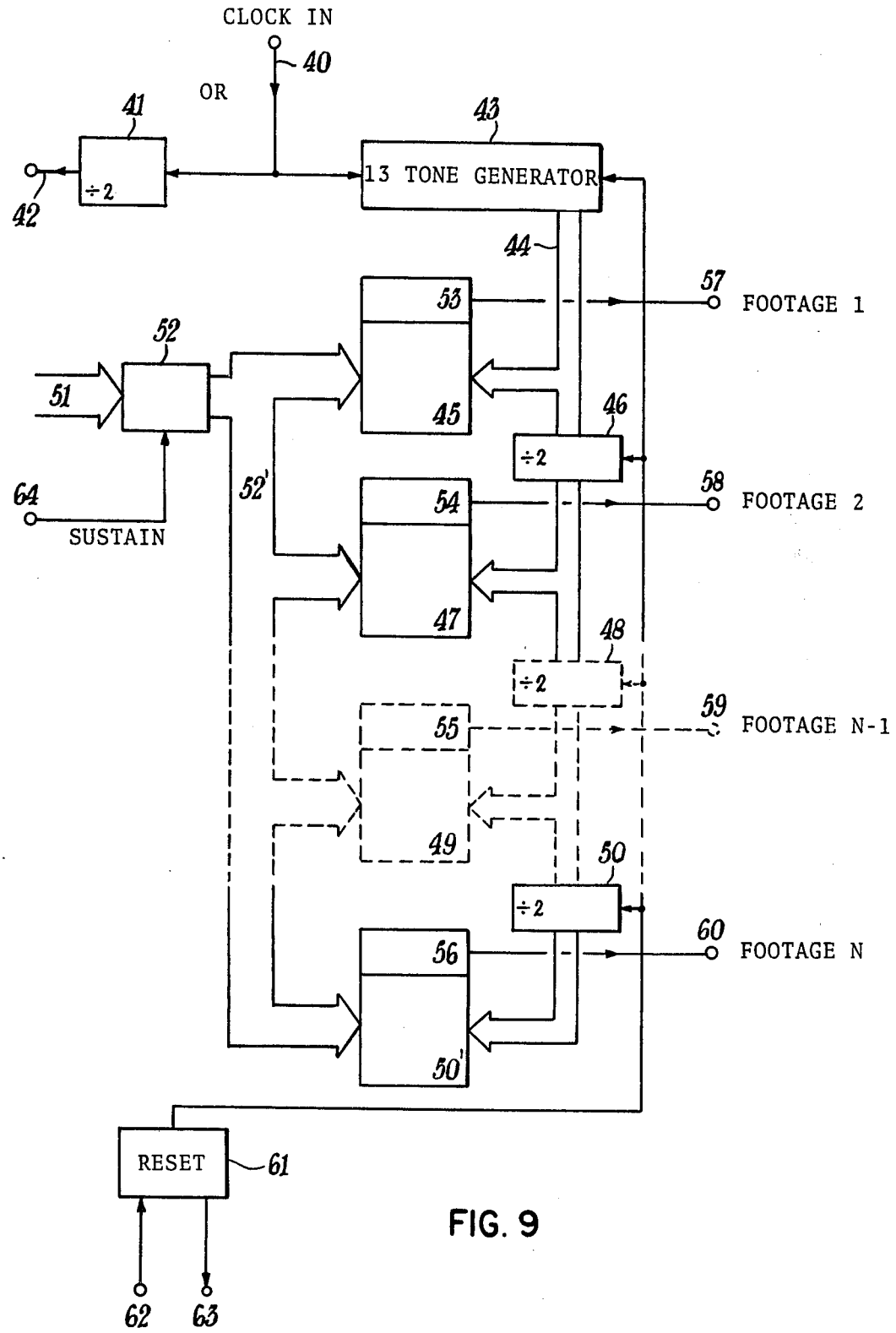
Figure 10:
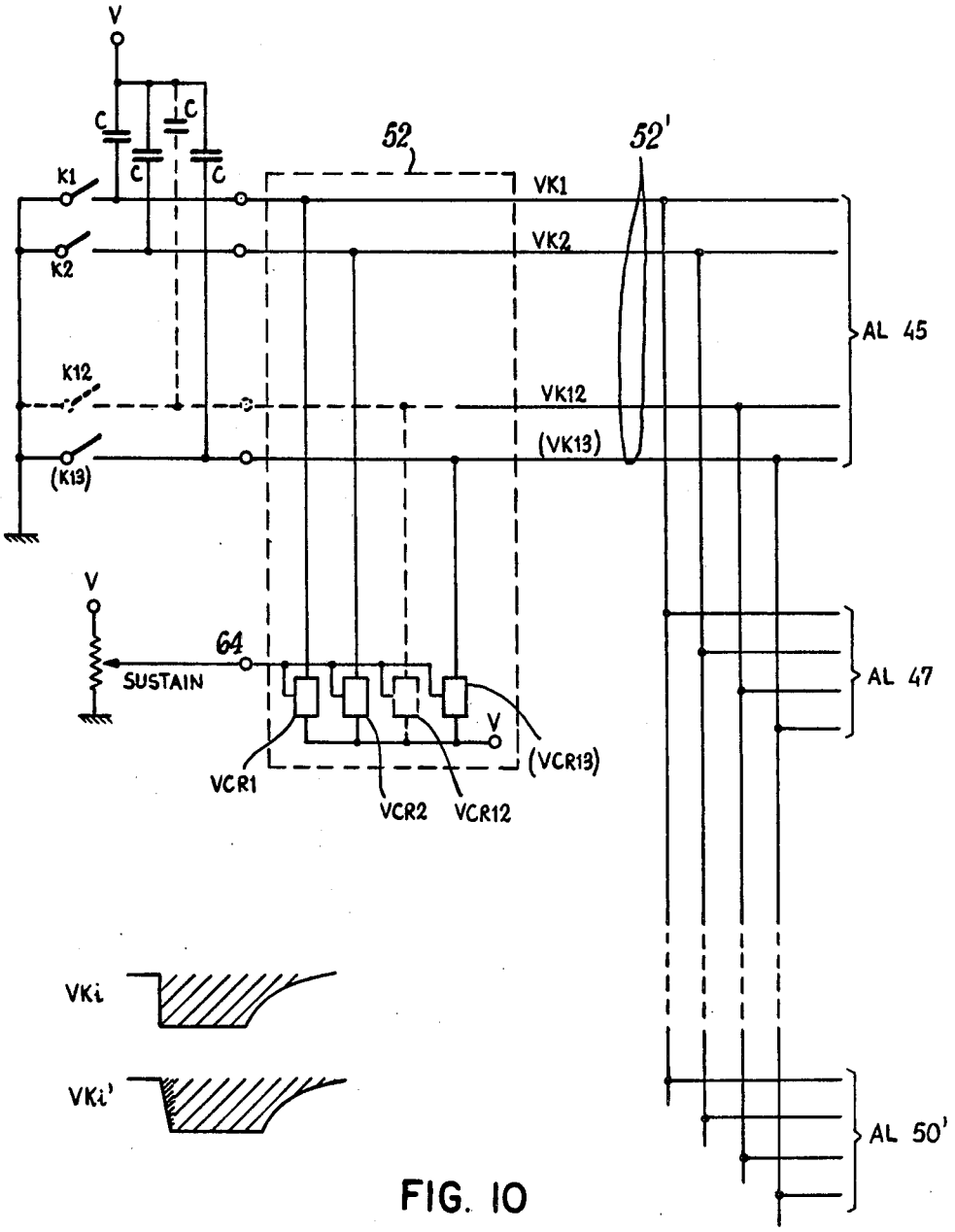
Figure 11:
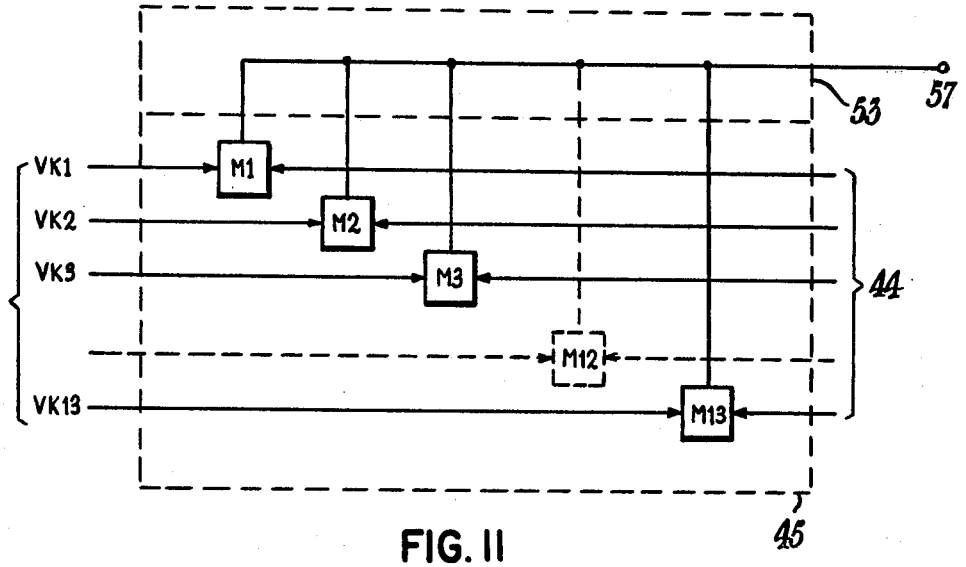
Figure 12:
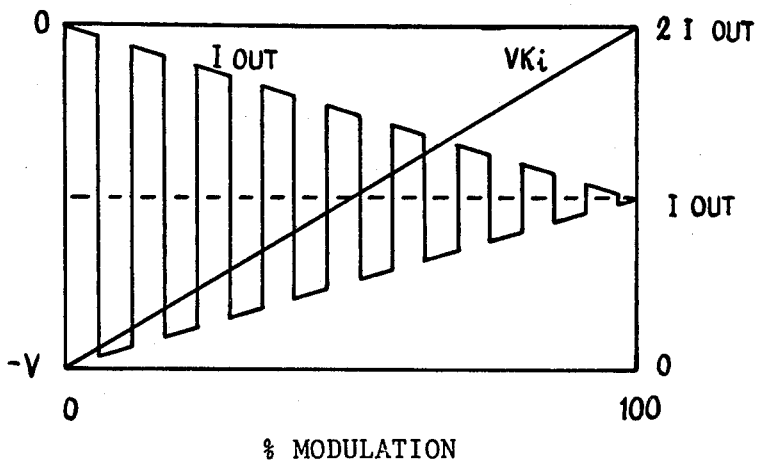
Figure 13:
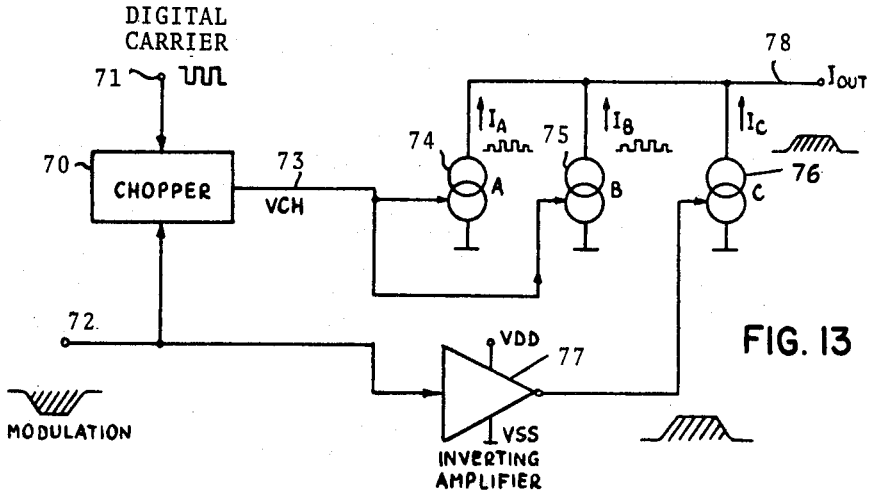
Figure 14:
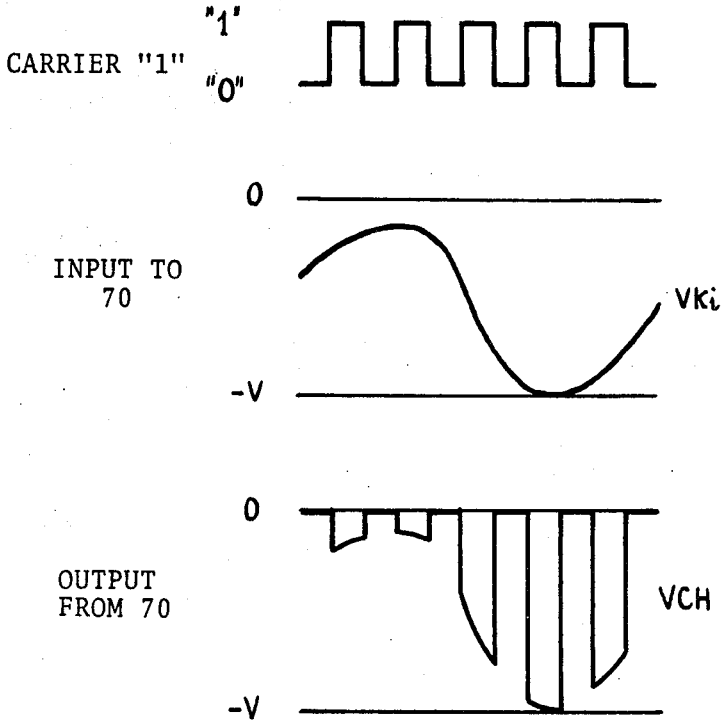
Figure 15:
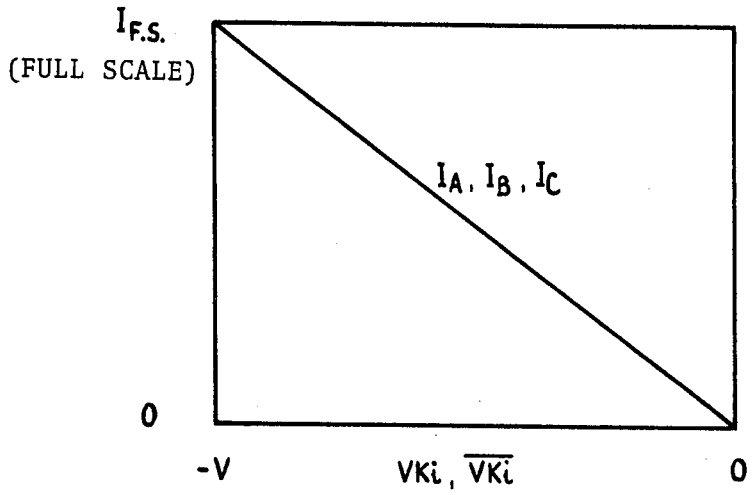
Figure 16:
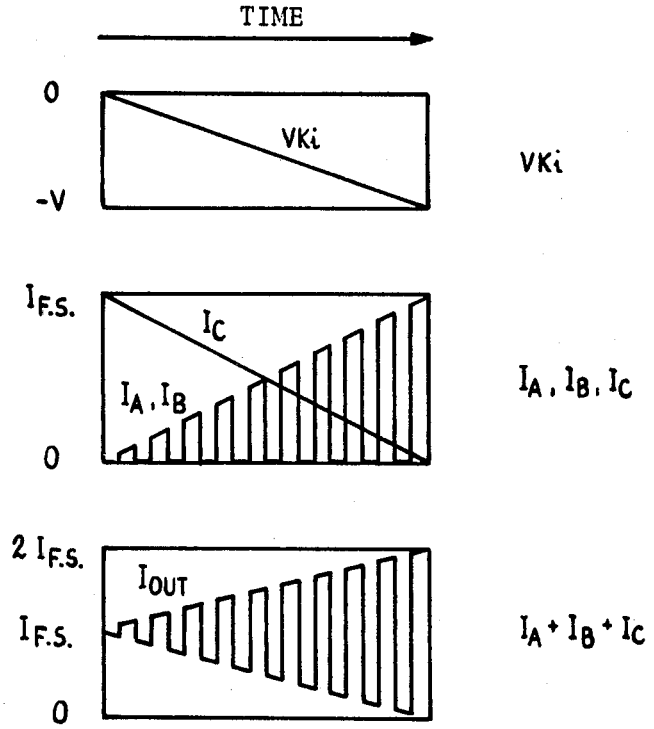
Figure 17A:
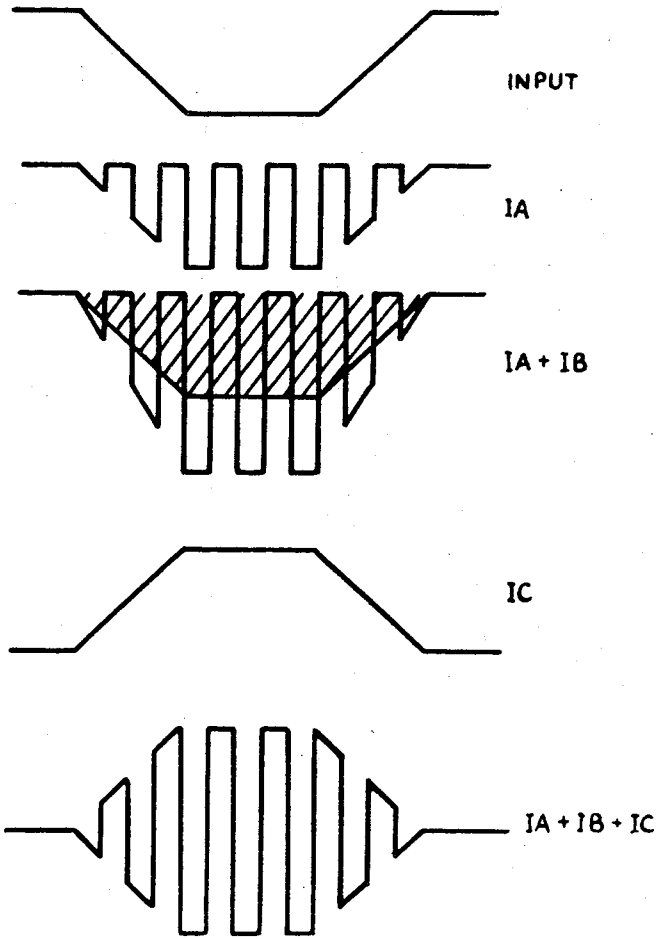
Figure 17:
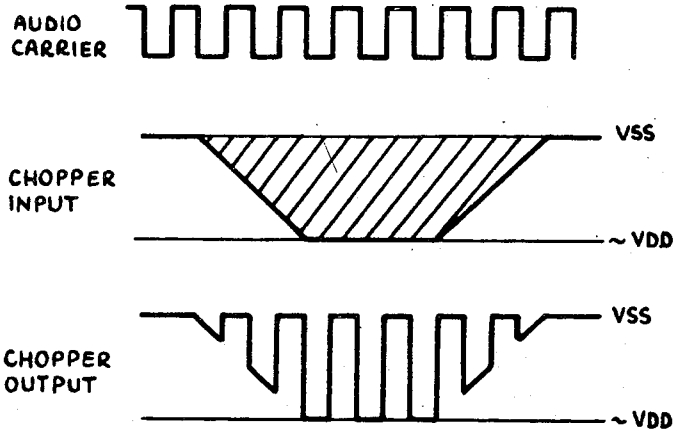

An embodiment of the invention will be described, by way of example, with reference to FIGS. 8–31 of the drawings, in which:

FIG. 8 shows a simplified block diagram, of the basic part of an electronic organ embodying the invention;

FIG. 9 shows a block schematic diagram in greater detail of a tone synthesizer on multiple octaves;

FIG. 10 shows diagramatically interconnections of the circuit of FIG. 9 with the lines of a keyboard octave;

FIG. 11 shows a detail of the circuit of FIG. 9;

FIG. 12 shows waveforms;

FIG. 13 shows a block diagram of one of the modulators;

FIGS. 14, 15 and 16 show waveforms relating to the operation of the modulators;

FIGS. 17 and 17*a* show further wave forms illustrating operation of the circuit of FIG. 13;

FIGS. 18*a* and 18*b* show an actual circuit and the equivalent circuit for the current generators shown in FIG. 13, respectively;

FIG. 19*a* shows a circuit embodiment of the circuit means for the compensation of the temperature variations and to the variation of process parameters in production of the circuit shown in FIG. 18;

FIG. 19*b* shows the general characteristics of the current generators of FIG. 18*a;*

Figure 20:
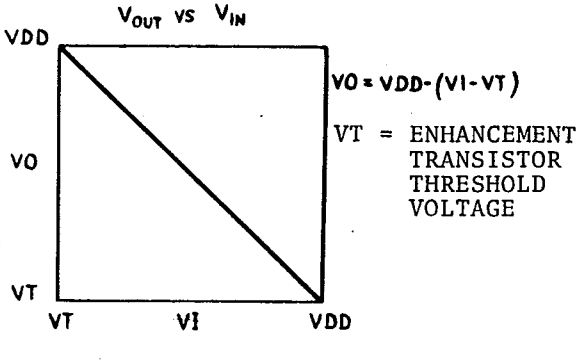
Figure 21:
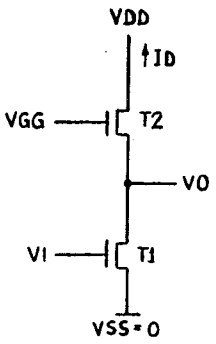
Figure 22:
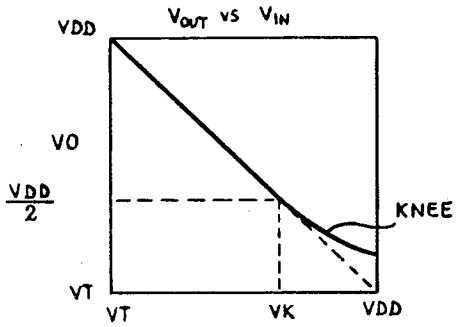
Figure 23:
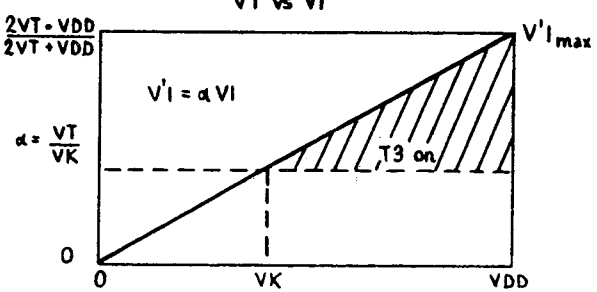
Figure 30:
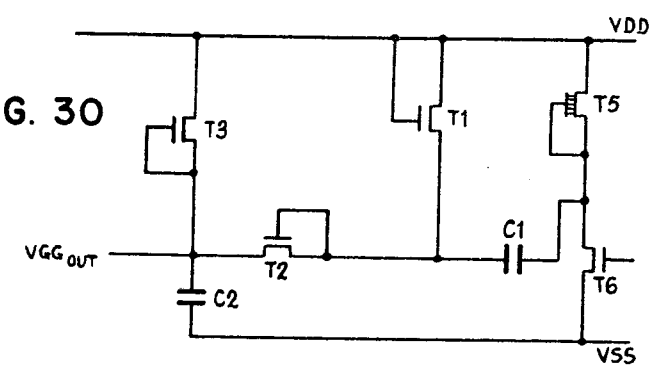
Figure 29:
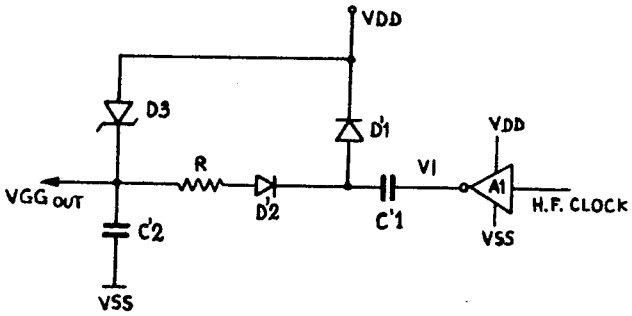
Figure 28:
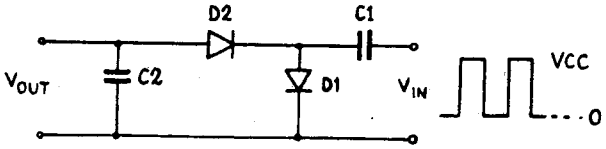
Figure 26:
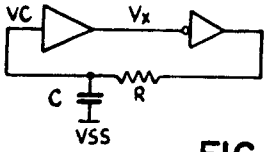
Figure 25:
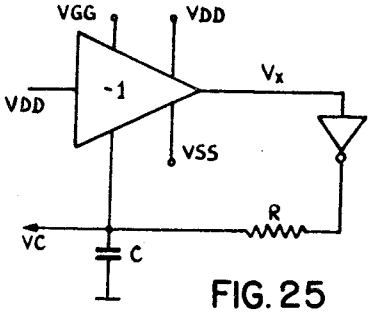
Figure 27:
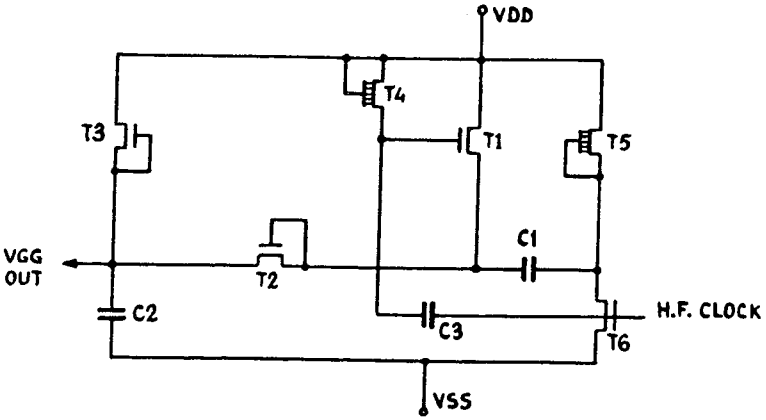

FIG. 20 shows the characteristic of the inverting amplifier shown in FIG. 13;

FIG. 21 shows a general digital inverter in accordance with MOS technology;

FIG. 22 shows the transfer characteristics of the circuit of FIG. 21;

FIG. 23 shows a wave for correcting the transfer error shown in FIG. 22;

FIG. 24 shows the electric diagram of the inverting amplifier provided with means for compensating the transfer error;

FIG. 25 shows a circuit for the generation of a compensation voltage, and FIG. 26 shows its equivalent circuit;

FIG. 27 shows a self-regulating circuit for generating a VGG voltage;

FIG. 28 shows in a first approximation the equivalent circuit corresponding to the circuit of FIG. 27;

FIG. 29 shows a circuit equivalent to that of FIG. 27 with a greater approximation;

FIG. 30 shows an implementation of the circuit of FIG. 29; and

Figure 31:
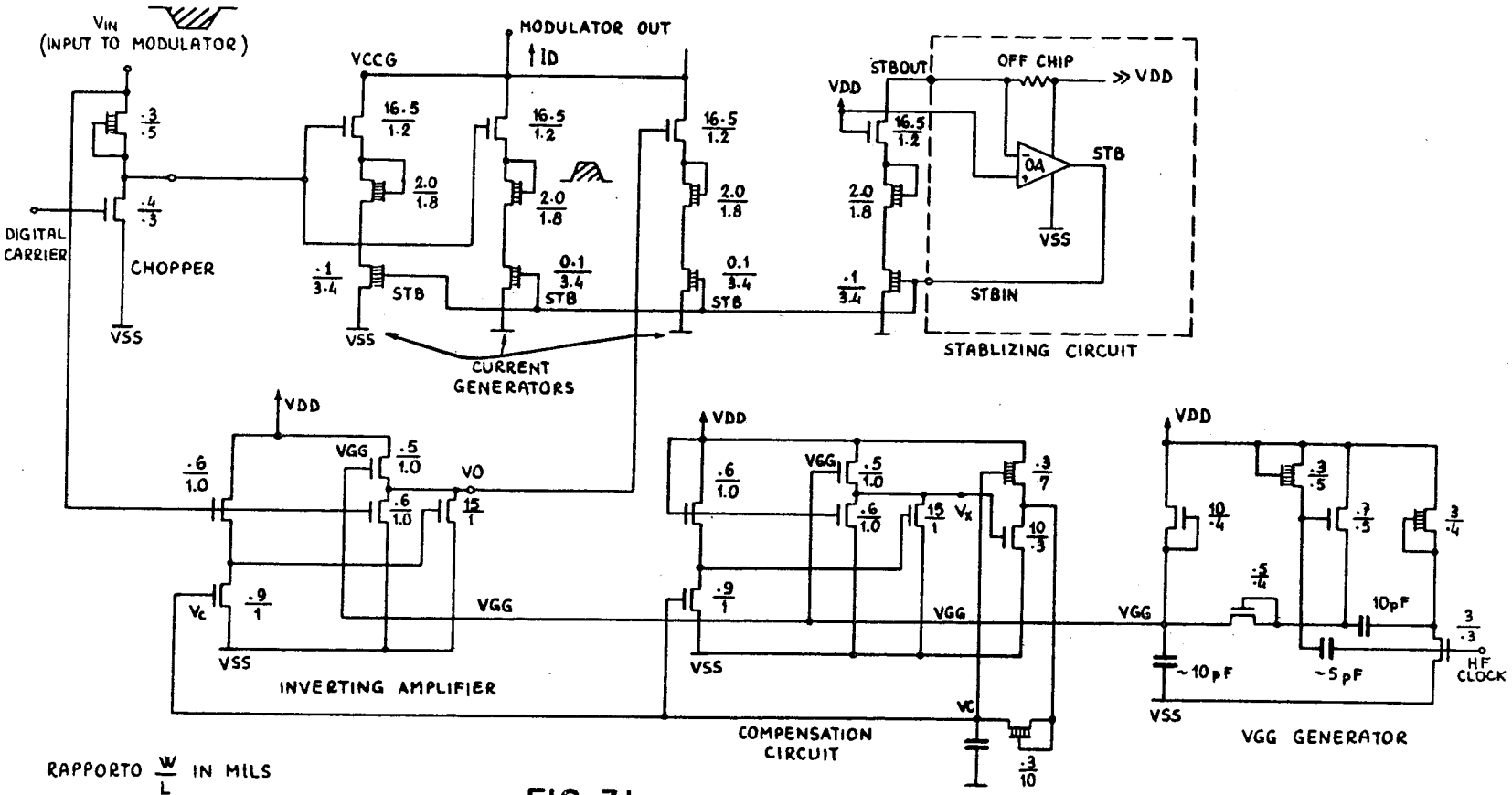

FIG. 31 shows the complete circuit of a modulator embodying the invention.

FIG. 8 shows in simplified manner, by way of example, the basic part of an organ including a circuit embodying the present invention. A keyboard 30 comprises three keyboard octaves 31, 32, 33 and the octave 33 comprises a thirteenth key 34. The group of contact wires of the keys (12+12+13) are brought to the circuits 35, 36, 37 each of which corresponds to one octave. The unit 37 corresponds to the highest octave and is driven by a master clock generator 38 operating at a frequency Fo. The units such as 37, 36 feed to the subsequent units 36, 35 a drive frequency at Fo/2, Fo/4 and so on. The outputs of the units 35, 36, 37 are connected to the draw bar selectors for the subsequent processing in order to produce in a known way the final sound of the organ.

Referring to FIG. 9, there is shown a detailed block diagram of a circuit embodying the invention. On an input terminal 40 there is applied the frequency of the master oscillator or the frequency divided by two of a device of higher order. Such frequency is connected to a toggle 41, the output 42 of which constitutes the input of a similar device of lower order. The input terminal 40 is also connected to the tone generator 43, which in a known way, provides on thirteen outputs 44, thirteen frequencies in harmonic relation each other (multiple of $\sqrt[12]{2}$).

The outputs 44 are connected to an array 45 of analog modulators and to an array 46 of thirteen toggle dividers. The outputs of the divider array 46 are connected to a second array of modulators 47 and to a second array 48 of thirteen toggles. The outputs of the toggles of the array 48 are connected to a further modulator array 49 and to a further array 50 of thirteen toggles, the outputs of which are connected to a further array 50' of modulators.

It has now been shown how the carriers are brought to the modulator arrays 45, 47 . . . 50'. The other input of the modulator arrays is constituted by the key board signals (i.e. signals produced by the actuation of one or more keys of the key board octave).

The key board signals (thirteen or twelve according to the position of the key board octave) are applied to the input arrays (thirteen) shown at 51. These signals are processed in a sustain network 52 (or another network which produces an envelope) which will be described hereinafter, and to which there is connected a control terminal 64 for controlling the envelope (sustain), and then to the modulation inputs of the modulator arrays 45, 47 . . . 50' by means of the bus 52'. Consequently, in the presence of one or more key signals there will be operated the appropriate modulators of each of the arrays 45, 47 . . . 50'.

The outputs of the single modulators contained in the arrays 45, 47 . . . 50' are connected, respectively, to mixer or summing circuits 53, 54, 55, 56. The outputs of the mixers 53 . . . 56 are connected to the footage output terminals 57, 58, 59, 60 which correspond to the register 1, register 2, register n-1, register n which can be connected in a known way to the draw bars of the organ for the subsequent processing of the signal.

For the correct operation of the circuit just shown, there is associated a general reset network 61 which transmits an initial reset signal to all the circuit blocks comprising dividers (43, 46, 48, . . . 50). The reset network 61 is substantially known and is provided with an input 62 and an output 63 so that the initial reset operation may be effected with a series connection of all the circuits in question.

Certain ones of the circuit blocks generally shown in the block diagram of FIG. 9 will be described in greater detail.

FIG. 10 shows more detail the elements 51, 52, 52' of FIG. 9. The keys of a key board octave connect, for instance to ground, the contacts K1, K2, . . . K12 (K13) setting to zero the voltages VK1, VK2, . . . VKi . . . VK12 (VK13). The voltages VK1, . . . (VK13) return to the level V following an exponential law determined by the value of capacitors C and by the value assured by each of the voltage controlled resistors (of a known type) VCR1, VCR2, . . . VCR12 (VCR13), the value of which is determined by a control voltage (sustain) adjusted by the potentiometer P. The voltages VKi will be of the form shown in FIG. 10. When a non abrupt "attack" is desired, there may be interposed between the contacts K1, . . . (K13) resistors which will give an attack slope as shown in the waveform VKi'.

FIG. 11 shows in more detail one of the arrays of modulators (45) and one of the arrays of mixers (53) shown in FIG. 9. To the modulators M1, M2, M3 . . . M12, M13, there are applied on one side the voltages VK1, VK2, . . . VK13 (FIG. 10), and on the other side, the tone voltages present on the bus 44 (FIG. 9). The mixer 53 is shown as a simple wired-OR connection as it is assumed that the modulators M1, M2, . . . have current outputs. It is to be remarked that each of the modulators is able to effect linear modulation from 0% to 100% as a function of the corresponding VKi around a constant d.c. level (off-set current) corresponding to one half of the maximum output swing of each modulator. The relationship between the voltage VKi and the output current is shown in FIG. 12. In FIG. 13 there is shown the functional schematic diagram of the modulators M1, M2 . . . . It is repeated again that the modulators in question have a current output for simplifying the mixture (see the comment to FIG. 11).

Each modulator comprises a chopper 70 to which at input 71 there is applied a square wave carrier or, in any case, an on-off carrier. To the terminal 72 there is applied a modulating voltage, the general signal VKi. As shown in FIG. 14, the modulated output VCH of the chopper 70 drives the identical current generators 74, 75 which provide the contributions $I_A$, $I_B$, respectively which are a linear function of the control voltage VCH. To the common bus 78 there is connected also a current generator 76 identical to the current generators 74, 75, which is driven by the inverting amplifier 77 (gain = −1) which provides the VKi inverted, so that the current contribution $I_C$ reproduces the behaviour of VKi. FIGS. 15 and 16 show the relationship between the voltage VKi and the currents $I_A$, $I_B$, $I_C$. It is essential to note that the sum of the three currents $I_A$, $I_B$, $I_C$, as it is shown in FIG. 16, is deprived of any direct current component, a fact which constitutes one of the basic advantages of a circuit embodying the present invention.

It is to be noted that for clarity of illustration it has been shown the use of twin current generators 74, 75 which provide two currents $I_A$, $I_B$. Clearly one could use a single current generator with a $I_{F.S.}$ equal to 2 $I_C$.

The modulator shown in FIG. 13 may advantageously be using low-threshold P-MOS technology with the ability to provide the following characteristics:

square wave in the acoustic frequency range;

full modulation range from VSS-VT to VDD, VT being the typical threshold of MOS enhancement transistors;

current output to permit the OR-wiring of several modulators;

substantial insensitivity to the variations of VDD with respect to VSS and to temperature changes;

modulation index from 0% to 100% (from VSS-VT to VDD, respectively).

Input and output signals of the chopper 70 are shown in FIG. 17 and they do not require particular comments, apart the fact that being the ouput of the chopper, as shown clamped to VSS contains a d.c. component which causes undesired effects and which must be therefore eliminated. This is obtained as we shall see by means of utilization of the current generator 75 which provides a d.c. component (current) adapted to compensate exactly the d.c. component introduced by the chopper and reproduced by the current generators 74,75. It should be remarked that three identical current generators are used because it is necessary a "double current" of modulated signal against a "single current" of modulating signal. By this arrangement the spread of characteristics in the manufacture of the integrated circuit leading to undesired unbalances can be avoided. The situation above indicated is shown in FIG. 17*a*, where it may be noted that the resultant of the three current generators 74, 75, 76 which provide respectively the currents IA, IB, IC lead to a combined wave form which is symmetrical with respect to the direct current component.

Up to now an ideal behaviour of the current generators, 74, 75 and 76 and of the unitary gain inverting amplifiers has been considered. The structure of a circuit embodying the invention is such as to minimize deviations from the ideal characteristics and to minimize the effects of the variations of process parameters in integrated circuit manufacture, as well as harmful effects in conditions of operation such as changes of temperature and a supply voltage. FIG. 18*a* shows one of the current generators of FIG. 13 comprising MOS transistors T1 and T2 of the "depletion" type and T3 of the "enhancement" type. In FIG. 18*b* there is shown the equivalent circuit.

In order to ensure the linearity of the current generator, it is necessary to maintain a constant relationship between the input voltage VG and the output current ID. This may be obtained in first place if the enhancement transistor T3 has an extremely large ratio W/L, with respect to the depletion transistors T1, T2 and, secondly, if the sum of the equivalent resistances R1+R2 remains constant with the changes of ID by operating the transistors T1 and T2 in the linear region of their characteristics. By satisfying these requirements, it is possible to write the relationship between input voltage and output current as follows:

$$ID = \frac{/VG - VT/}{R1 + R2} \text{ ; for } VDD \leqq VG \leqq VT,$$

where VDD is the supply voltage and VT the threshold voltage of T3.

However, the value of IDmax, corresponding to the maximum value which VG may reach (in the limiting case corresponding to VDD) is dependent on the temperature and the variation of the parameters of the manufacturing process. It is therefore necessary to provide means for compensating these variations:

in FIG. 19A means for achieving such compensation are shown. On the integrated circuit chip there is realized a structure identical to the one of FIG. 18A, comprising the transistors T'1, T'2, T'3. In the transistor T'3 of FIG. 19A the gate is kept at the voltage VDD, and its drain is brought to the non-inverting input of the operational amplifier OA, and supplied through R3 with a voltage /V/>>/VDD/. The inverting input of the operational amplifier OA is tied to VDD. The output STB of the operational amplifier OA is brought to the gate of T'1 and to the corresponding transistors located in the same circuit location as T'1. The operational amplifier OA is off-chip and produces a stabilizing voltage $STB_{IN}$ for all the current generating circuits which are voltage controlled. The effect of this automatic bias voltage is to maintain constant both IR and $ID_{MAX}$. The overall characteristics of the voltage controlled current generators are shown in FIG. 19B, where it can be remarked that for gate voltages VG more negative than the threshold voltage VT, the ID current is a linear function of the gate voltage VG applied to the transistor T3.

Having thus described the voltage controlled current generators, the full swing inverting amplifier appearing in the schematic diagram of FIG. 13, for the driving of the current generator 75 will be described. FIG. 20 shows the external characteristics of such inverting amplifier. The output voltage VO is substantially a linear function of the input voltage VI, and both VO and VI have a swing which goes from VT (threshold voltage of the enhancement transistors) up to the supply voltage VDD. In the PMOS technology such characteristics cannot be reproduced with a conventional digital type inverter. A more complex arrangement is therefore required as will appear hereinafter. Consider a general digital inverter as it is shown in FIG. 21. The transistor T1 constitutes the amplifying element to which an input voltage VI is applied, and the transistor T2 to which a bias voltage VGG is applied in order to constitute formally a load resistor for the drain of T1. The output voltage VO is taken at the interconnection point between the drain of T1 and the source of T2 (both T1 and T2 are enhancement transistors).

Assuming that both T1 and T2 are operating in their saturation condition (drain current independent from the voltage applied between drain and source) we may write:

$$/VO/ \geqq /Vi-VT \quad \text{for T1}$$

$$/VDD/ \geqq /VGG-V'T/ \quad \text{for T2} \qquad (1)$$

where VT and V'T are the threshold voltage of the transistors T1 and T2, respectively.

Consequently, the currents through the two transistors T1, T2 are respectively:

$$ID1 = ID = K' \frac{W1}{L1} (VI - VT)^2 \qquad (a)$$

$$ID2 = ID = K' \frac{W2}{L2} (VGG - VO - V'T)^2 \qquad (b)$$

where K' is the gain of the transistors, V'T is the threshold voltage of the transistor T2 taking into account the "body effect" and the ratios $$\frac{W1}{L1} \text{ and } \frac{W2}{L2}$$

are representative of the geometrical characteristics of the transistors T1, T2 (W=width of the channel area, L=length of the channel area).

By resolving the relationships (a), (b) one obtains for the output voltage VO the following relationship $$VO = VGG - V'T - K1(VI - VT) \qquad (c)$$

where K1 is a constant which keeps into account the above geometries of the two transistors.

The relationship (c) shows the linearity existing between VO and VI with the previously stated assumptions.

Among the possible values of VGG as it is shown in (1), there is one and only one which provides VO=VDD for ID=O when /VI/≦/VT/ and which is $$VGG = VDD + V'T.$$

One has to take into account the fact that the threshold values, the body effect and the changes of temperature may have an appreciable effect on the value of V'T. Consequently, VGG must be such as to keep into account these variations and in the following there will be disclosed "on chip" circuits which provide the necessary variations for VGG.

The expression relating to the output voltage VO becomes therefore:

$$VO = VDD - K1(VI - VT)$$

which is a straight line.

$$\text{Assuming } K1 = 1, \text{ i.e. } \sqrt{\frac{W1}{L1}} / \sqrt{\frac{W2}{L2}} = 1$$

The inverter will satisfy the requirements of the inverting amplifier in the range $$/VI - VT/ \leqq /VO/ \leqq /VDD/.$$

By forcing /VO/ below /VI–VT/, the transistor T1 goes out of its saturation region and the relationship of the inverter (c) does not hold anymore.

This is shown by the flattening of the transfer curve as is shown in FIG. 22. This flattening may be eliminated by connecting in parallel to transistor T1 an enhancement type transistor T3, with relative large geometry, driven by a voltage V'I as it is shown in FIG. 23. The correction action of the transistor results from the dashed area of FIG. 8.

Considering the possible values of VT and VDD, it can be easily shown that the transistor T3 works always in its saturation region.

Consider the currents through the transistors T1, T2 and T3 for $$/VK/ \leqq /VI/ \leqq /VDD/$$

Remembering that the transistors T2 and T3 work in their saturation region, and that T1 works in the linear region, the following is valid:

$$ID1 = K' \frac{W1}{L1} [2(VI - VT) VO - VO^2] =$$

$$= K' \frac{W1}{L1} [(V1 - VT)^2 - (VI - VT - VO)^2]$$

$$ID2 = K' \frac{W2}{L2} (VDD - VO)^2$$

$$ID3 = K' \frac{W3}{L3} (V'I - VT)^2$$

for satisfaction of Kirkhoff's law, $$ID2 = ID1 + ID3$$

With the increase of ID2, the output voltage VO decreases, and consequently the term ID1 may be neglected without introducing an appreciable error, and the expression becomes $$\frac{W2}{L2}(VDD - VO)^2 \simeq (V'I - VT)^2$$

therefore $$VO = VDD - K2(V'T - VT)$$

where K2 is a term which takes into account the geometries of T2 and T3, and $V'I = \alpha VI$ being $\alpha < 1$.

Remembering that $$V'I - VT = \alpha(VI - VK)$$

we have $$VT = VDD - \alpha C2(VDD - VK)$$

$$\text{assuming } C2 = \frac{1}{\alpha} \frac{VDD - VT}{VDD - VK}$$

this relationship represents the dashed contribution in the diagram of FIG. 23. It is now possible to combine the separate effects of T1 and T3 in order to obtain the necessary transfer characteristic for the inverting amplifier.

The complete electric diagram of the inverting amplifier is shown in FIG. 24 together with its equivalent diagram; VGG and VC are inputs for compensation voltages which will be discussed in the following:

Always with reference to FIG. 24, when it is VI=VDD, the output VO of the amplifier becomes VO=VT=VDD−αC2(V1−VK) which may be writtent as follows:

$$VT = VDD - \alpha C2 [(V1 - VT) - \frac{VDD}{2}]$$

In order to maintain valid this relationship for all the permitted values of VT and VDD, it is necessary to arrange for the adjustment of the partition factorα. This is effected by applying a compensation voltage VC on the gate of T4 which together with T5 constitutes a voltage divider for the input voltage VI, said voltage VC, by varying the conduction of T4 has the effect of changing the coefficientα. The compensation voltage VC may be obtained with a second amplifier identical to the inverting amplifier, with VI always equal to VDD, connected in an active feedback circuit as shown in FIG. 25, the equivalent circuit of which is shown in FIG. 26.

The operation of the circuit shown in FIGS. 25, 26 consists in sensing the voltage Vx on the output of the amplifier, having its input connected to VDD by an inverting amplifier having a very high gain, the output of which is brought back to the input VC of the same compensating amplifier through a low pass filter RC. By considering the equivalent schematic of FIG. 26 it can be seen that VC is stabilized in order to maintain Vx practically equal to the threshold voltage VT of the inverter if the loop gain is very high. The network RC introduces a dominant pole in order to maintain the stability of the feedback circuit. The VC voltage produced in this way is applied to the input VC (gate of T4) of FIG. 24, in order to adjust the value of α in the inverting amplifier.

In the discussion of the operation of the inverting amplifier (FIG. 9) it has been indicated the need of a self-regulating VGG which takes into account the supply voltage VDD, the threshold voltage VT, the body effect and the temperature, i.e.:

$$VGG = VDD + V'T.$$

This VGG is obtained on the chip by means of a circuit as shown in FIG. 27. In order to understand the operation of the circuit shown in FIG. 27 consider the circuit shown in FIG. 28. The $V_{IN}$ varies between zero and a value Vcc. The network comprising C1, D1, D2, C2 provides on its output terminals an output voltage Vout=−Vcc. Consider now FIG. 29. An inverter A1 is driven by a clock having a relatively high frequency (higher than the operating frequency of the circuit embodying this invention). On the output of the amplifier A1 there is a voltage VI which has a swing substantially between $V_{SS}$ and VDD. The combination comprising C'1, D'1, D'2, R, C'2, is practically identical to the circuit of FIG. 13 and, on the node R, C'2 there is a voltage which is directed towards values more negative than VDD and limited by the Zener D3. The resistor R constitutes on one side the load of the Zener diode D3 and contributes on the other side, together with C2, to reduce the ripple on the output. The presence of the Zener diode D3 allows the following result to be obtained:

$$/VGG\text{out}/ = /VDD/ + /V_{Zener}/$$

As will be seen, the Zener diode D3 is arranged so that its characteristic voltage changes automatically with the changes of temperature and the supply voltage VDD to provide that VGG voltage desired for the self-stabilized biassing for the inverting amplifier of FIG. 24, assuming that the $V_{Zener}$ is selected equal to V'T, following it in its variations.

The actual structure of the circuit of FIG. 29 is shown in FIG. 27. Before discussing FIG. 27, FIG. 30 will be considered, which is a simplified arrangement of the MOS implementation of the circuit of FIG. 29. With reference to FIG. 30, the transistors T5 and T6 constitute the amplifier or inverter A1 of FIG. 29. The diode D'1 is constituted by the transistor T1 with the gate short circuited with the line of VDD, the diode D'2 and the resistor R are constituted by the transistor T2 with the gate shorted with the left electrode of the capacitor C1; the Zener diode D3 is constituted by the transistor T3 with the gate shorted with the electrode of the capacitor C2 connected with the terminal of the VGG out. These equivalences of diodes cannot be assimilated to conventional diodes because they show a conduction threshold which may reach also values of 5 volts. It is necessary, at least for the diode constituted by T1 to reduce the equivalent threshold substantially to zero in order to allow to the capacitor C1 to charge to the full value of VDD. This is realized as it is shown in FIG. 27 with the introduction of the capacitor C3 and of the depletion transistor T4 in the shown arrangement. The combination of the capacitor C3 and of the transistor T4 allows the gate of the transistor T1 to be brought to a voltage more negative than VDD during the phase of charging of C1. The transistor T3 in the arrangement shown in FIG. 27 behaves as a Zener diode with $V_{Zener}=V'T$, because this transistor starts to conduct only when the voltage at its terminals overcomes the threshold value of an MOS enhancement transistor with a source biassed to VDD.

FIG. 31 shows a complete schematic diagram of a modulator embodying the invention. In this figure, which follows the former figures grouped together, there are indicated the rations W/L for the several MOS transistors constituting the circuit.

Having indicated the geometries of the transistor, it may be added that the process parameters for a standard temperature of 20° C. may be the following:

a threshold voltage of about 1.5 volts for the enhancement transistor;

a threshold voltage of about 6.0 volts for the depletion transistors.

What is claimed is:

1. An electronic tone synthesizer comprising a plurality of octave inputs for receiving input signals corresponding at least to notes of an octave scale of a musical instrument; a plurality of groups of analog amplitude modulators, each group comprising a number of modulators equal in number to said plurality of octave inputs, each modulator in a group having a carrier input, a modulating input and an output; for each modulator group, means connecting the modulator outputs to a respective footage output for that modulator group; carrier generator means for producing an ordered frequency submultiple series of sets of tone signals, each set comprising a number of tone signals having harmonically related frequencies of a musical scale octave and corresponding in number to the number of amplitude modulator means in each said modulator group; means connecting said octave inputs to respective modulating inputs of corresponding modulators of each group and means for connecting each set of tone signals to the carrier inputs of corresponding modulators of an individual one of the modulator groups such that an input on any particular octave input produces at the footage outputs an amplitude modulated series of submultiple frequency tone signals.

2. A synthesizer according to claim 1, including modulation envelope generation means connecting said keyboard octave inputs and the modulating inputs of the modulators of said groups.

3. A synthesizer according to claim 1 or claim 2, wherein each said modulator comprises a chopper amplifier means for utilizing modulating input signals on said modulating input to amplitude chop said tone signal carrier inputs; said chopper amplifier means having an output connected to a control input of first voltage modulated current generator means; means for inverting modulating signals on said modulating input and supplying the inverted modulating signals to a control input of a second voltage modulated current generator means; and means for additively combining currents generated by said first and second current generators means to produce a pulsed current at said modulator output in which direct current components arising through operation of said chopper amplifier means are substantially eliminated.

4. A synthesizer according to claim 1, wherein said modulator comprises a chopper amplifier and wherein said tone signals are square waves; means connecting the chopper amplifier output as a control input to first and second voltage modulated current generator means; inverter amplifier means for receiving said modulating signal as an input voltage and connecting the inverted modulating signal as a control input to a third voltage modulated current generator means; and means connecting the output of a first, second and third current generator means in parallel to a common output terminal for producing a pulsed output current in which direct current components arising through operation of said chopper amplifier means are substantially eliminated.

5. A modulator according to claim 4, wherein said current generator means each comprises an enhancement mode field effect transistor having a gate comprising the control input of said current generator, means connecting said enhancement transistor in series with first and second depletion mode field effect transistors, said first depletion mode field effect transistor operating as an equivalent resistor having a fixed value and the second depletion mode field effect transistor operating as a variable resistor controlled by a stabilizing voltage.

6. A modulator according to claim 5, wherein said depletion mode field effect transistor operating as a variable resistor has a gate drive stabilizing circuit also comprising an enhancement mode field effect transistor connected in series with two depletion mode field effect transistors operating, respectively, as an equivalent resistor having a fixed value and a variable resistor controlled by a gate stabilizing voltage; means connecting the gate of the enhancement mode field effect transistor of the stabilizing circuit to a voltage VDD and the drain of that transistor to a voltage /V/>/VDD/ through a voltage drop resistor; means connecting the drain of the said enhancement mode field effect transistor to a non-inverting input of an operational amplifier, said amplifier having an inverting input connected to said voltage VDD; and means connecting the output of said operational amplifier to the gates of the depletion mode field effect transistors operating as variable equivalent resistors in the current generators and in the stabilizing circuit.

7. A modulator according to claim 4, wherein said inverting amplifier comprises a digital type inverter operatively associated with a linearity compensation transistor driven by a fraction of the input voltage to the inverting amplifier voltage divider means comprising two series connected enhancement mode field effect transistors for deriving said input voltage fraction, means for applying the input voltage of the inverting amplifier to the gate of one of said enhancement mode field effect transistors and means for applying a compensating voltage to the gate of the other one of said enhancement mode field effect transistors.

8. A modulator according to claim 7, comprising an amplifier means, identical to said inverting amplifier for generating said compensation voltage for the inverting amplifier and having an input connected to a voltage VDD and an output connected by a further inverter and a resistor-capacitor network to the gate of the other one of said enhancement mode field effect transistors said resistor-capacitor network constituting a frequency stabilizing dominant pole.

9. A modulator according to claim 6, wherein said inverting amplifier means has an input for connection to a compensation voltage VGG, said compensation voltage being obtained by means for generating a voltage /VGG/>/VDD/ by rectification and replication of a voltage having a frequency higher than the modulator operating frequency.

10. A modulator according to claim 7, wherein each of said field effect transistors is a PMOS transistor, wherein said enhancement mode field effect transistors have a gate threshold voltage of about 1.5 volts and wherein said depletion mode field effect transistors have a gate threshold voltage of about 6.0 volts.

11. An electronic tone synthesizer comprising respective groups of octave inputs for receiving input signals corresponding at least to notes of an individual keyboard octave musical scale of a musical instrument; clock pulse generator means for generating base frequency clock pulses and means for successively frequency dividing the base frequency clock pulses; for each said group of octave inputs;

a plurality of groups of analog amplitude modulators, each group comprising a number of modulators equal in number to said plurality of octave inputs, each modulator in a modulator group having a carrier input, a modulating input and an output; for each modulator group, means connecting the modulator outputs to a respective footage output for that modulator group; carrier generator means comprising tone signal generator means responsive to a clock pulse input of selected frequency for producing an ordered frequency submultiple series of sets of tone signals, each set of tone signals having harmonically related frequencies of a musical scale octave and corresponding in number to the number of amplitude modulators in a modulator group, means for connecting the octave inputs associated with a particular octave to respective modulating inputs of corresponding modulators of said modulator group; means for connecting each set of tone signals to the carrier inputs of corresponding modulators of an individual one of the modulator groups; and means for connecting the base frequency clock pulses and the successively frequency divided clock pulses to the tone generator means of the respective modulator groups.

12. A synthesizer according to claim 11, including a common reset network means for synchronizing all of the said tone generator means and said frequency divider means.

13. An electronic musical instrument including a keyboard arranged in octaves, a plurality of tone synthesizers each comprising respective groups of octave inputs, each group of inputs connected to keys of at least a keyboard octave of the said musical instrument; clock pulse generator means for generating base frequency clock pulses and a means for successively frequency dividing the base frequency clock pulses; for each group of octave inputs;

a plurality of groups of analog amplitude modulators, each group comprising a number of modulators equal in number to said plurality of octave inputs, each modulator in a modulator group having a carrier input, a modulating input and an output; for each modulator group, means connecting the modulator outputs to a respective footage output for that modulator group; carrier generator means comprising tone signal generator means responsive to a clock pulse input of selected frequency for producing an ordered frequency submultiple series of sets of tone signals, each set of tone signals having harmonically related frequencies of a musical scale octave and corresponding in number to the number of amplitude modulators in a modulator group, means for connecting the octave inputs associated with a particular octave to respective modulating inputs of corresponding modulators of said modulator group; means for connecting each set of tone signals to the carrier inputs of corresponding modulators of an individual one of the modulator groups; and means for connecting the base frequency clock pulses and the successively frequency divided clock pulses to the tone generator means of the respective modulator groups.

14. A musical instrument according to claim 13, including reset network means for synchronizing all of the said tone generator means and said frequency divider means associated with the keyboard octaves.

15. A musical instrument according to claim 13, including modulation envelope generation circuits connecting said keyboard octave inputs and said groups of modulators.

16. A musical instrument according to claim 13, wherein each said modulator comprises a chopper amplifier means for utilizing modulating input signals on said modulating input to amplitude chop said tone signal carrier inputs, said chopper amplifier means having an output connected to a control input of first voltage modulated current generator means; means for inverting modulating signals on said modulating input and supplying the inverted modulating signals to a control input of a second voltage modulated current generator means; and means for additively combining currents generated by said first and second current generator means to produce a pulsed current at said modulator output in which direct current components arising through operation of said chopper amplifier means are substantially eliminated.

* * * * *